US008836542B2

(12) United States Patent
Gremmert et al.

(10) Patent No.: US 8,836,542 B2
(45) Date of Patent: Sep. 16, 2014

(54) SYSTEMS AND METHODS FOR IMPROVING PREDICTED PATH DISPLAY OUTPUT

(75) Inventors: Scott R. Gremmert, Redmond, WA (US); Timothy Crawford, Redmond, WA (US)

(73) Assignee: Honeywell International Inc., Morristown, NJ (US)

( * ) Notice: Subject to any disclaimer, the term of this patent is extended or adjusted under 35 U.S.C. 154(b) by 622 days.

(21) Appl. No.: 13/161,847

(22) Filed: Jun. 16, 2011

(65) Prior Publication Data

US 2012/0319872 A1 Dec. 20, 2012

(51) Int. Cl.

| | |
|---|---|
| ***G08B 23/00*** | (2006.01) |
| ***G08G 5/00*** | (2006.01) |
| ***G08G 5/04*** | (2006.01) |

(52) U.S. Cl.

CPC ..... *G08G 5/0052* (2013.01); *G08G 5/0034* (2013.01); *G08G 5/045* (2013.01); *G08G 5/0021* (2013.01); *G08G 5/003* (2013.01); *G08G 5/0078* (2013.01); *G08G 5/0039* (2013.01); *G08G 5/0013* (2013.01)

USPC ..... 340/963; 340/951; 340/950; 340/971; 701/14

(58) Field of Classification Search

CPC ... G08G 5/0052; G08G 5/045; G08G 5/0021; G08G 5/003; G08G 5/0013; G08G 5/0078; G08G 5/0034; G08G 5/0039; G01C 23/00; G01C 23/005

USPC ..... 340/950, 951, 963, 971–980; 701/14–18, 440–441

See application file for complete search history.

(56) References Cited

U.S. PATENT DOCUMENTS

| | | | | |
|---|---|---|---|---|
| 8,046,119 | B2 * | 10/2011 | Bitar et al. | 701/14 |
| 8,145,365 | B2 * | 3/2012 | Flotte et al. | 701/8 |
| 8,412,392 | B2 * | 4/2013 | Jayathirtha et al. | 701/14 |
| 2006/0129285 | A1 | 6/2006 | Gremmert | |
| 2008/0046171 | A1 * | 2/2008 | Bitar et al. | 701/208 |
| 2009/0105943 | A1 | 4/2009 | Ferro et al. | |
| 2010/0004801 | A1 * | 1/2010 | Flotte et al. | 701/8 |
| 2011/0208374 | A1 * | 8/2011 | Jayathirtha et al. | 701/5 |
| 2011/0301842 | A1 * | 12/2011 | Krupansky et al. | 701/206 |
| 2012/0319872 | A1 * | 12/2012 | Gremmert et al. | 340/963 |

FOREIGN PATENT DOCUMENTS

| | | | |
|---|---|---|---|
| WO | 2006065782 | A1 | 6/2006 |
| WO | 2009035757 | A2 | 3/2009 |

OTHER PUBLICATIONS

Search Report from counterpart EPC Application No. 12170373.0, dated Dec. 12, 2012. 3 pp.

Intention to Grant from counterpart EPC Application No. 12170373.0, dated Jan. 8, 2014. 20 pp.

* cited by examiner

*Primary Examiner* — Hoi Lau

(74) *Attorney, Agent, or Firm* — Shumaker & Sieffert, P.A.

(57) ABSTRACT

Systems and methods for alerting a flight crew when the vertical situation display may be providing incomplete information due to the presence of a non-computed trajectory segment in the flight plan. A processing device in signal communication with a flight management system, a position measuring system, and a velocity measuring system receives a flight plan from the flight management system and determines if the flight plan includes any non-computed trajectory segments. If at least one of time or distance to the beginning of a next non-computed trajectory segment is less than a threshold value, the processing device generates an alert that information displayed on a vertical situation display may be incomplete. An output device outputs the generated alert.

12 Claims, 5 Drawing Sheets

SYSTEMS AND METHODS FOR IMPROVING PREDICTED PATH DISPLAY OUTPUT

BACKGROUND OF THE INVENTION

In a vertical situation display (VSD) based on flight plan trajectory there is a case in which the displayed data are incomplete. This occurs when a segment has "no computed trajectory" (NCT) see FIG. 1. Typical situations where an NCT segment is experienced are in an aborted landing (missed approach) situation (FIG. 3), or on a final turn onto a runway straight-in approach after manual repositioning (FIG. 4). When an NCT segment exists, the VSD in a flight plan display mode will not present any data beyond where the NCT segment begins. If a hazard (terrain or weather) exists within or beyond the NCT segment, the VSD will not show it (FIG. 2). This is a problem because range=time and time=safety margin. If the crew are able to see hazards well in advance, they can react with gentle corrections. If the crew does not see the hazard until they are right on top of it (in the dark or during bad weather), then emergency maneuvers are required to avoid the hazard.

SUMMARY OF THE INVENTION

The present invention provides systems and methods for alerting or assisting a flight crew when the vertical situation display (VSD) may be providing incomplete information due to the presence of a non-computed trajectory segment in the flight plan. An exemplary system located on an aircraft includes a surveillance system, a flight management system, one or more position measuring systems, and a processing device. The processing device is in signal communication with the surveillance system, the flight management system, and the positioning system. The processing device receives a flight plan from the flight management system and determines if the flight plan includes any non-computed trajectory segments. Then the processing device receives aircraft speed and position information and determines at least one of time or distance to a beginning of a next determined non-computed trajectory segment, based on the received aircraft speed and position information. If the at least one of time or distance to the beginning of the next determined non-computed trajectory segment is less than a threshold value, the processing device generates a signal that information displayed on a vertical situation display may be incomplete. An alert or automatic reversionary display may be triggered based on the generated signal.

In one aspect of the invention, the system includes a vertical situation display. The processing device automatically switches the vertical situation display to a trajectory viewing mode, if at least one of the time or distance to the beginning of the next determined non-computed trajectory segment is less than the threshold value. The generated alert includes at least one of a visual or audible indication that the vertical situation display has been switched to the trajectory viewing mode.

In another aspect of the invention, the processing device assigns an end of the flight plan as a beginning of a non-computed trajectory segment.

BRIEF DESCRIPTION OF THE DRAWINGS

Preferred and alternative embodiments of the present invention are described in detail below with reference to the following drawings.

DETAILED DESCRIPTION OF THE INVENTION

Figure 1:
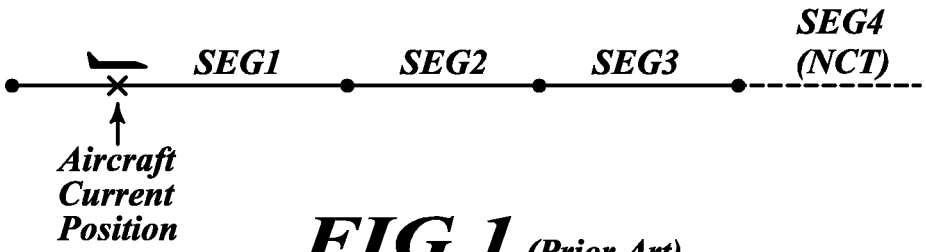
FIG.1 (Prior Art)
FIGS. 1-4 illustrate situations associated with the prior art.
Figure 2:
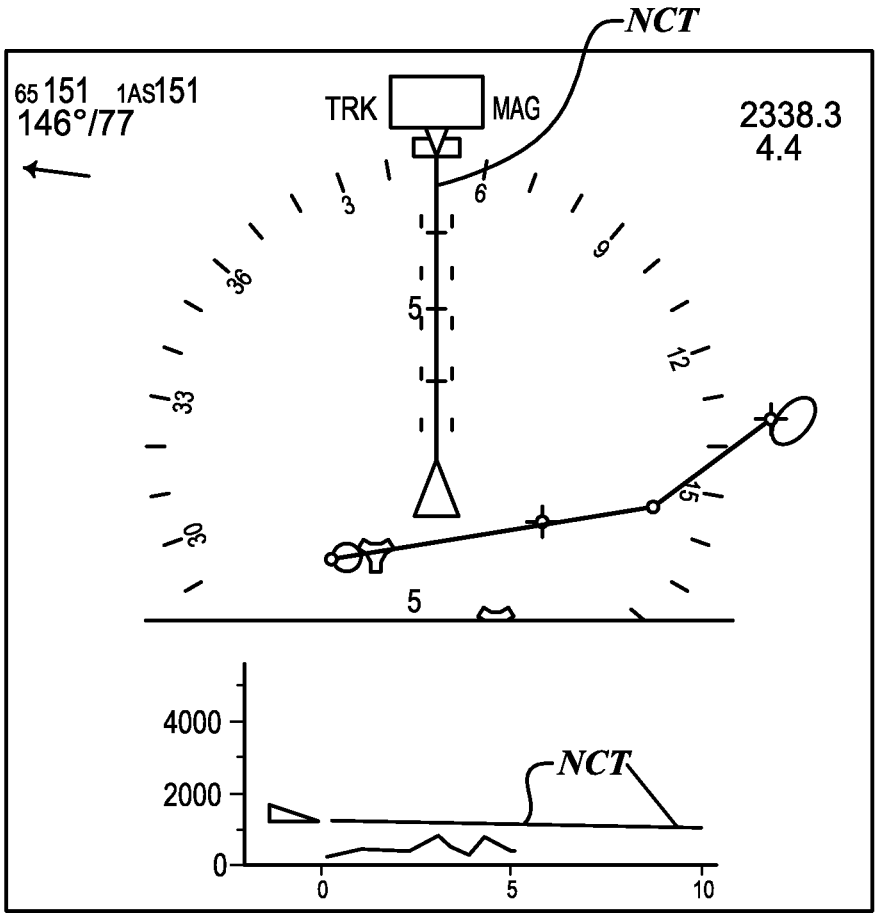
FIG.2 (Prior Art)
Figure 3:
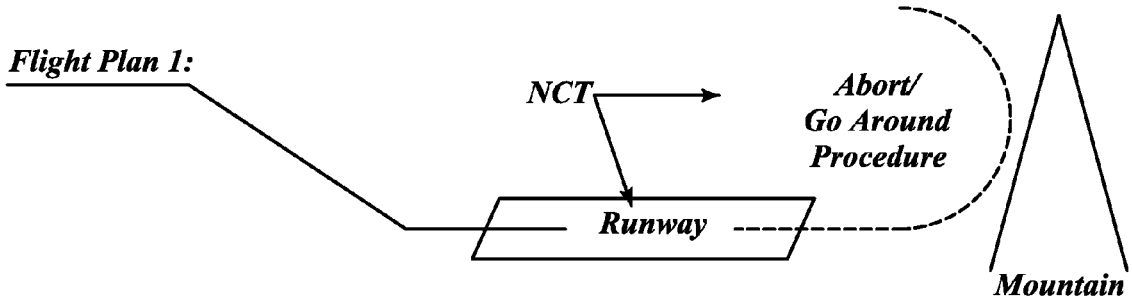
FIG.3 (Prior Art)
Figure 4:
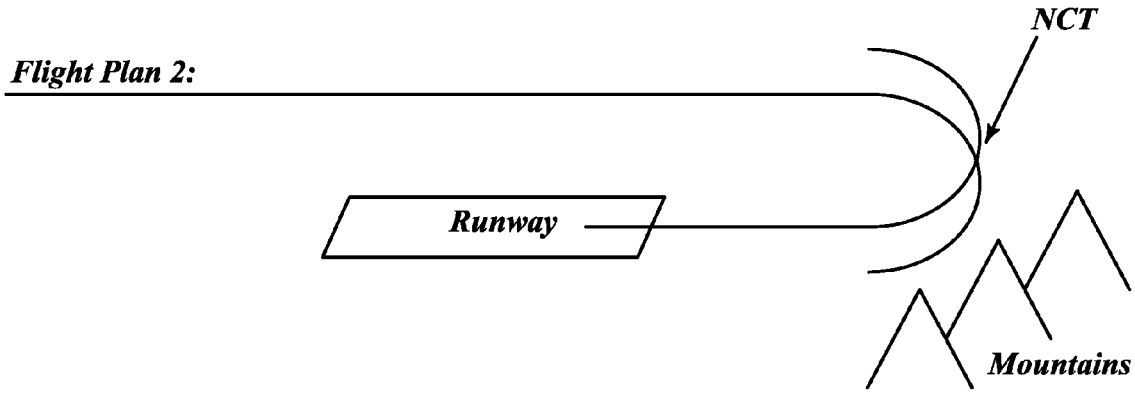
FIG.4 (Prior Art)
Figure 5:
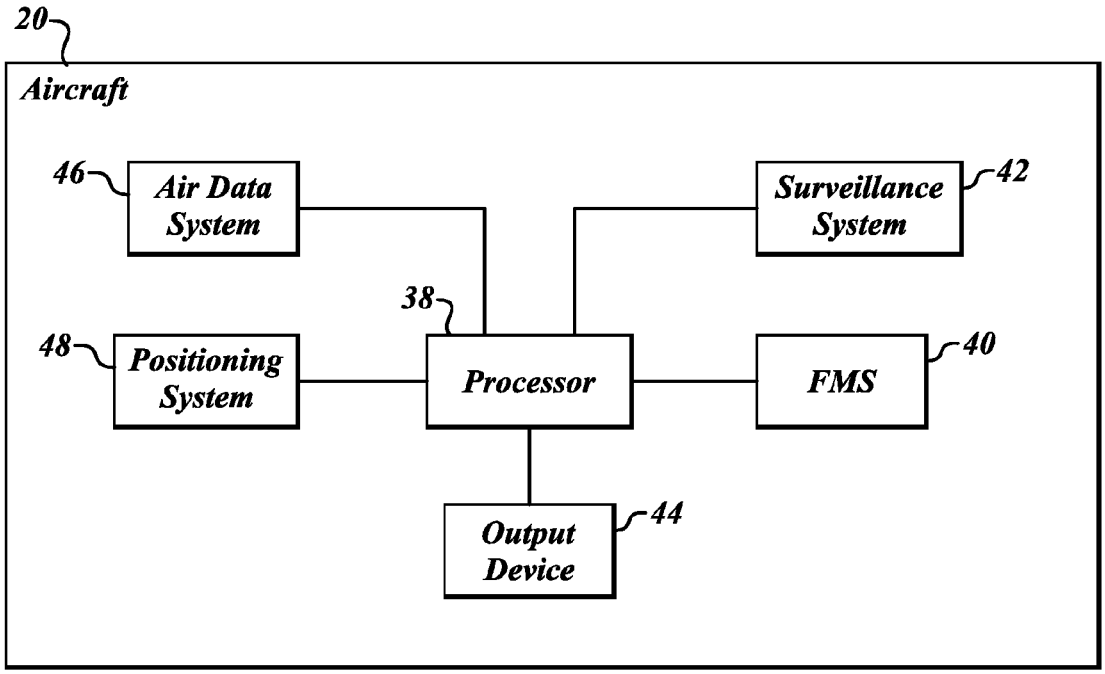
FIG. 5 is a block diagram of an exemplary system formed in accordance with an embodiment of the present invention.

As shown in FIG. 5, an exemplary aircraft 20 includes a processor 38 that is in data communication with at least a flight management system (FMS) 40, an optional surveillance system 42, one or more output devices 44, a positioning system 48 and an air data or velocity measuring system 46. The processor 38 receives flight plan information from the FMS 40 and determines if there exists incomplete information (described below) with the flight plan information. If incomplete information exists, the processor 38 outputs an alert and/or switches the operational mode of the surveillance system 42 (e.g., weather, terrain, and/or traffic). The operational mode relates to what information from the surveillance system 42 is to be displayed on a vertical situation display (VSD) (the output device 44).

In a bare minimum system the processor 38 generates an input that is sent to the surveillance system 42 or the processor generated input is sent to the flight crew in parallel with data from the surveillance system 42. This bare minimum system would need to know current position and ground speed of the aircraft.

The processor 38 receives as input the flight plan (intended path). The processor 38 separates the flight plan into manageable chunks (segments). If the processor 38 determines that a special case segment (such as a non-computed trajectory (NCT) segment) exists in the flight plan, the cumulative length of the segments (or partial/remaining segments) is determined for the segments (or partial/remaining segments) starting at the aircraft's current position using position information received from the positioning system 48 (e.g., global positioning system (GPS) or inertial reference system (IRS)) and terminating at the beginning of the first special case or nondisplayable segment (or at the end of the flight plan, whichever comes first).

The processor 38 then divides cumulative length by the current aircraft ground speed received from the position measurement system (e.g. GPS, IRS, or FMS) 48 to obtain an estimate of the look-ahead time (or distance). If available, the intended speed during each segment can be multiplied by the segment length to obtain a more accurate estimate. The estimated look-ahead time is then compared to a predetermined limit (or limit table) to determine if "sufficient" look-ahead time exists. The look-up table can be indexed by aircraft height above the ground, current height compared to the minimum safe altitude for the sector, or by phase of flight. Close to the ground or in an approach phase, a constant limit, perhaps two minutes, might prove sufficient. In cruise phase, where the dominant hazard is severe weather rather than terrain, a longer look-ahead, such as 10 to 20 minutes, might be more advisable. If the processor 38 determines that sufficient look-ahead time does not exist, the processor 38 switches from displaying hazards along the flight plan to displaying hazards along the aircraft's current track and/or outputs an alert (visually, audibly, or tactilely) that indicates the pending condition.

If the processor 38 switches the mode of the display (the output device 44) an indication of display mode ("Along Flight Plan" or "Along Track") is provided to the flight crew. This could be done with text, with distinctive coloring, line-typing (e.g., dashes) or other graphical indicia. If type of line were used, then part of the display could be along the flight path and the remainder along an extension vector (i.e., current track). If automatic mode switching of the display is not enabled, then an alternative would be to output an alert, such as a "no data" indication ("purple haze" or other distinctive graphical element), or by text that says essentially "switch to track", or perhaps a flashing mode indicator. Other alerting options may be used.

Figure 6:
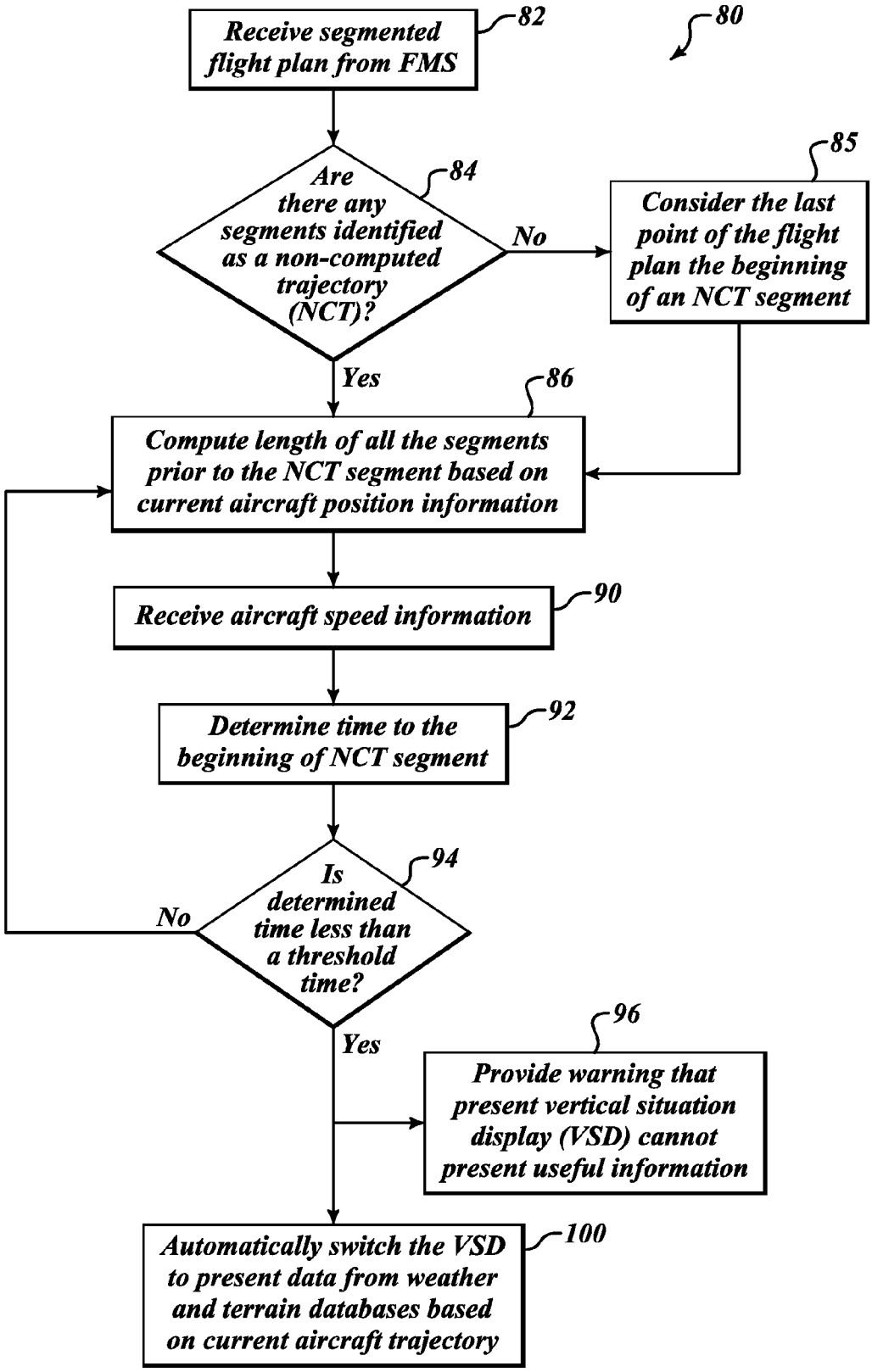
FIG. 6 is a flowchart of an exemplary process performed by the system shown in FIG. 5.

FIG. 6 illustrates a process 80 performed by the processor 38. First, at a block 82, a segmented flight plan is received from the FMS 40. At a decision block 84, the processor 38 determines if there are any segments in the flight plan indentified as an NCT segment. If no segments are identified as NCT segments, then the processor 38 considers, at block 85, the last point of the flight plan to be the beginning of an NCT segment. Then the process 80 continues to block 86. If an NCT segment exists in the flight plan, then, at block 86, the length of all the segments prior to the beginning of the NCT segment is computed from the aircraft's current location. Next, at a block 90, aircraft speed and location information are received at the processor 38. At a block 92, the time when the aircraft will reach the beginning of the NCT segment is determined using the length of time to the beginning of the NCT segment and aircraft speed information. At a decision block 94, the processor 38 determines if the determined time is less than a threshold time value. If the determined time is not less than the threshold time value, the process 80 returns to the block 86 to repeat. If the determined time is less than (or equal to) the threshold time value, then, at a block 96, an alert is provided to the flightcrew. The alert indicates that the VSD cannot present complete hazard (weather/terrain) information along the flight plan. The alert may include time or distance information as to when the VSD will not be presenting complete hazard information.

At a block 100, the processor 38 optionally automatically switches the VSD to a trajectory mode. In the trajectory mode, the VSD presents data from the weather and terrain databases or any other hazard information (e.g., traffic) based on current aircraft trajectory. If an automatic switch of modes of the VSD has occurred, then the alert indicates a mode switch of the VSD has occurred, due to data truncation in flight plan mode.

Figure 7:
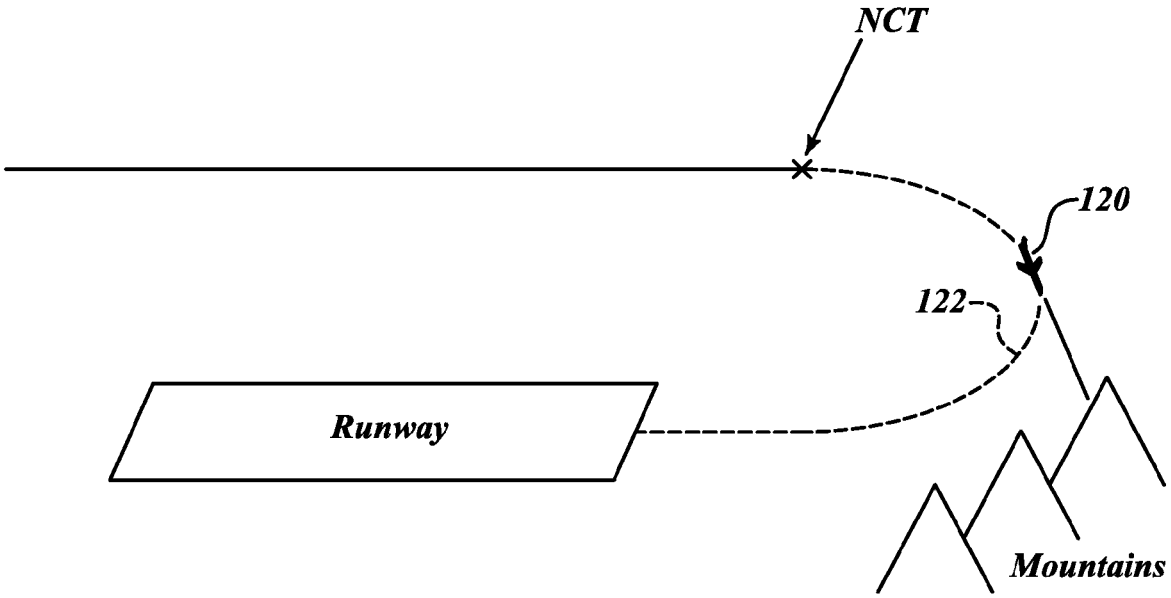
FIG. 7 shows an aircraft on approach to landing.
Figure 8:
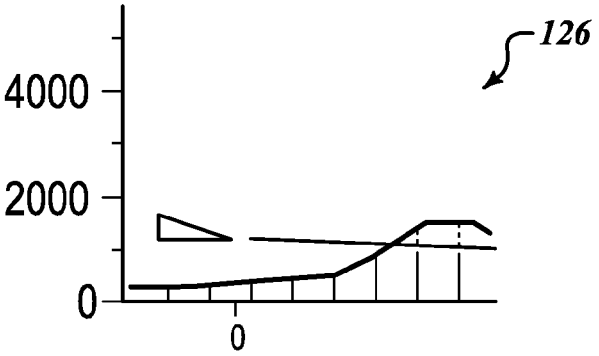
FIG. 8 shows an exemplary vertical situation display of the situation shown in FIG. 7 for an aircraft employing the present invention.

FIGS. 7 and 8 show a situation in which an aircraft 120 has started an NCT segment 122 of a flight plan. In this example, a VSD 126 of the aircraft 120 has been switched to display surveillance information based on the current trajectory of the aircraft 120. Thus, the mountains are visible on VSD 126, thereby giving the flight crew adequate warning of the local terrain hazard near the point where the FMS can no longer provide guidance.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A method performed by a processing device on an aircraft, the method comprising:

receiving a flight plan from a flight management system;

determining if the flight plan includes any non-computed trajectory segments;

receiving aircraft speed and position information;

determining at least one of time or distance to the beginning of a next determined non-computed trajectory segment, based on the received aircraft speed and position information; and if at least one of the time or distance to the beginning of the next determined non-computed trajectory segment is less than a threshold value, generating an alert that information displayed on a vertical situation display may be incomplete.

2. The method of claim 1, further comprising:

if at least one of the time or distance to the beginning of the next determined non-computed trajectory segment is less than a threshold value, generating a signal for automatically switching a vertical situation display to the trajectory viewing mode.

3. The method of claim 2, wherein the generated alert comprises at least one of a visual, audible, or tactile indication that the vertical situation display has been switched to the trajectory viewing mode.

4. The method of claim 1, wherein determining if the flight plan includes any non-computed trajectory segments comprises determining that the flight plan does not include any non-computed trajectory segments, the method further comprising:

determining the next non-computed trajectory segment based on the flight plan, wherein determining the next non-computed trajectory segment comprises assigning a last point of the flight plan as a beginning of a non-computed trajectory segment.

5. A system on an aircraft, the system comprising:

a flight management system configured to generate a flight plan;

a position measuring system configured to determine position information of the aircraft;

a velocity measuring system configured to determine velocity information of the aircraft;

a processing device being in signal communication with the flight management system, the position measuring system, and the velocity measuring system, the processing device being configured to:

receive the flight plan from the flight management system;

determine if the flight plan includes any non-computed trajectory segments;

receive the aircraft velocity and position information;

determine at least one of time or distance to a beginning of a next determined non-computed trajectory segment, based on the received aircraft velocity and position information; and if the at least one of time or distance to the beginning of the next determined non-computed trajectory segment is less than a threshold value, generate an alert that information displayed on a vertical situation display may be incomplete; and an output device configured to output the generated alert.

6. The system of claim 5, further comprising:

a surveillance system configured to provide at least one of terrain, traffic or weather information; and a vertical situation display configured to display the information provided by the surveillance system, wherein the processing device automatically switches the vertical situation display to a trajectory viewing mode, if the at least one of time or distance to the beginning of the next determined non-computed trajectory segment is less than the threshold value.

7. The system of claim 6, wherein the generated alert comprises at least one of a visual or audible indication that the vertical situation display has been switched to the trajectory viewing mode.

8. The system of claim 5, wherein the processing device is configured such that if the processing device determines the flight plan does not include any non-computed computed trajectory segments, then the processing device determines the next non-computed trajectory segment by at least assigning a last point of the flight plan as a beginning of a non-computed trajectory segment.

9. A system performed by a processing device on an aircraft, the system comprising:

a means for receiving a flight plan from a flight management system;

a means for determining if the flight plan includes any non-computed trajectory segments;

a means for receiving aircraft speed and position information; and a means for determining at least one of time or distance to the beginning of a next determined non-computed trajectory segment, based on the received aircraft speed and position information; and generating an alert that information displayed on a vertical situation display may be incomplete, if at least one of the time or distance to the beginning of the next determined non-computed trajectory segment is less than a threshold value.

10. The system of claim 9, further comprising:

a means for generating a signal for automatically switching a vertical situation display to the trajectory viewing mode, if at least one of the time or distance to the beginning of the next determined non-computed trajectory segment is less than a threshold value.

11. The system of claim 10, wherein the generated alert comprises at least one of a visual, audible, or tactile indication that the vertical situation display has been switched to the trajectory viewing mode.

12. The system of claim 9, further comprising:

a means for determining the next non-computed trajectory segment by at least assigning a last point of the flight plan as a beginning of a non-computed trajectory segment.

* * * * *